US011321979B2

(12) United States Patent
Goto et al.

(10) Patent No.: US 11,321,979 B2
(45) Date of Patent: May 3, 2022

(54) SECURITY APPARATUS AND METHOD FOR CONTROLLING THE SAME

(71) Applicant: NTT DOCOMO, INC., Chiyoda-ku (JP)

(72) Inventors: Osamu Goto, Chiyoda-ku (JP); Kouki Hayashi, Chiyoda-ku (JP); Kazuto Oomori, Chiyoda-ku (JP)

(73) Assignee: NTT DOCOMO, INC., Chiyoda-ku (JP)

( * ) Notice: Subject to any disclaimer, the term of this patent is extended or adjusted under 35 U.S.C. 154(b) by 0 days.

(21) Appl. No.: 17/044,551

(22) PCT Filed: Feb. 21, 2019

(86) PCT No.: PCT/JP2019/006535
§ 371 (c)(1),
(2) Date: Oct. 1, 2020

(87) PCT Pub. No.: WO2019/202845
PCT Pub. Date: Oct. 24, 2019

(65) Prior Publication Data

US 2021/0158642 A1 May 27, 2021

(30) Foreign Application Priority Data

Apr. 16, 2018 (JP) ..... JP2018-078182

(51) Int. Cl.
*G07C 9/00* (2020.01)

(52) U.S. Cl.
CPC ..... *G07C 9/00563* (2013.01); *G07C 9/00896* (2013.01)

(58) Field of Classification Search
CPC ..... G07C 9/00563; G07C 9/00896
See application file for complete search history.

(56) References Cited

U.S. PATENT DOCUMENTS 9,892,576 B2 * 2/2018 Kursun ..... H04L 63/0861
2019/0057561 A1 * 2/2019 Zavesky ..... G16H 40/67

FOREIGN PATENT DOCUMENTS

JP 2005-163406 A 6/2005
JP 2010-102633 A 5/2010
JP 2012-132287 A 7/2012

OTHER PUBLICATIONS

Office Action dated Jul. 6, 2021 in counterpart Japanese application No. 2020-513995, along with an English translation.

* cited by examiner

*Primary Examiner* — Daniell L Negron
(74) *Attorney, Agent, or Firm* — Oblon, McClelland, Maier & Neustadt, L.L.P.

(57) ABSTRACT

A security apparatus identifies a first user associated with a first terminal apparatus within an area of a house to which entry is limited by a lock apparatus, and a second user associated with a second terminal apparatus approaching the house. The security apparatus determines a requirement for unlocking for the second user, based on a relationship of the second user with respect to the first user, and then determines whether the requirement for unlocking is satisfied. When the requirement for unlocking is satisfied, the security apparatus controls unlocking of the lock apparatus.

7 Claims, 9 Drawing Sheets

FIG. 6
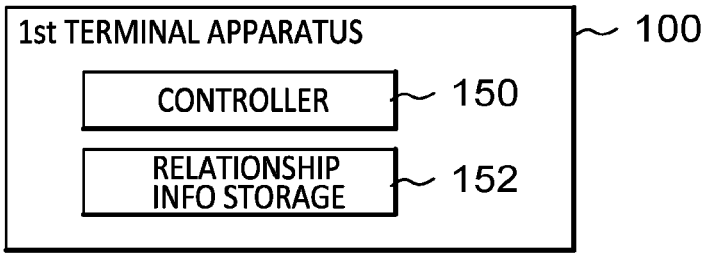
FIG. 7
<TERMINAL ID: RELATIONSHIP INFORMATION ON XXXXX-01 (USER NAME : A)>
| TERMINAL ID | USER NAME | RELATIONSHIP |
|---|---|---|
| XXXX-01 | B | FRIEND |
| XXX1-0X | D | RELATIVE |
| ..... | ..... | ..... |
| XX4X-20 | F | FRIEND |
| X7X3-X4 | G | ROOMMATE |
FIG. 8
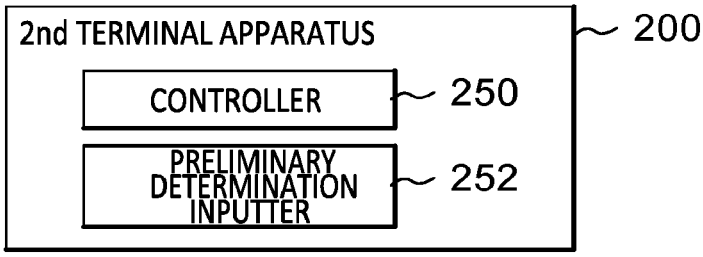

<UNLOCKING-REQUIREMENT TABLE>

TBL

| RELATIONSHIP | REQUIREMENT OF UNLOCKING | PRELIMINARY DETERMINATION |
|---|---|---|
| ROOMMATE | TERMINAL ID CONFIRMATION | |
| RELATIVE | TERMINAL ID CONFIRMATION | |
| | PASSWORD CONFIRMATION | ENABLED |
| FRIEND | TERMINAL ID CONFIRMATION | |
| | PASSWORD CONFIRMATION | ENABLED |
| | BIOMETRIC AUTHENTICATION | ENABLED |
| NOT REGISTERD | CONFIRMATION THROUGH INTERCOM | |

SECURITY APPARATUS AND METHOD FOR CONTROLLING THE SAME

TECHNICAL FIELD

The present invention relates to a security apparatus and to a method for controlling the same.

BACKGROUND ART

In recent years, a system has been proposed that unlocks an entrance door or the like by using a lock apparatus (see Patent Document 1, for example). In this system, identification information, such as a value representative of a characteristic part of a facial image for identifying a person, is registered in association with category information, such as a resident, a relative, or a friend. When a visitor standing in front of an intercom is a resident, the lock apparatus is unconditionally unlocked. In contrast, when the visitor is a friend of a resident, the lock apparatus is unlocked on condition that someone is in the house and that the person permits the unlocking.

RELATED ART DOCUMENT

Patent Document

Patent Document 1: Japanese Patent Application Laid-Open Publication No. 2012-132287

SUMMARY OF THE INVENTION

Problem to be Solved by the Invention

However, the above-mentioned technique has a problem in that when a friend of a father visits, as long as a resident is in the house, the lock apparatus is unlocked based on the same requirement for unlocking whether the father is in the house.

Means of Solving the Problems

In order to satisfy one of the objects described above, a security apparatus according to one aspect of the present invention includes a determiner configured to, when (i) a first user associated with a first terminal apparatus within an area to which entry is limited by a lock apparatus, and (ii) a second user associated with a second terminal apparatus approaching the area are identified, determine a requirement for unlocking in which the lock apparatus is unlocked by the second user in accordance with a relationship of the second user with respect to the first user; and a controller configured to determine whether the requirement for unlocking is satisfied, in which when the requirement for unlocking is satisfied, the controller is configured to control unlocking of the lock apparatus.

Effect of the Invention

With the security apparatus according to the one aspect described above, a requirement for unlocking of a lock apparatus is determined in accordance with a relationship of a second user who is approaching an area with respect to a first user who is in the area to which entry is limited by the lock apparatus. When the requirement for unlocking is satisfied, the locking apparatus is unlocked. Thus, the disadvantage can be solved in which, when a friend of a father visits the place, as described above, whether the father is in the area, the lock apparatus is unlocked based on the same requirement for unlocking.

BRIEF DESCRIPTION OF THE DRAWINGS

FIG. 6 is a block diagram showing examples of functions constructed in the first terminal apparatus.

FIG. 7 is a diagram showing an example of relationship information.

FIG. 8 is a block diagram showing examples of functions constructed in the second terminal apparatus.

MODES FOR CARRYING OUT THE INVENTION

Embodiments of the present invention will be described below with reference to the drawings. Because the following embodiments are preferred specific examples of the present invention, various limitations that are technically preferred are given. However, the scope of the present invention is not limited thereto by the embodiments unless there is a description that particularly limits the present invention hereinafter.

First Embodiment

Figure 1:
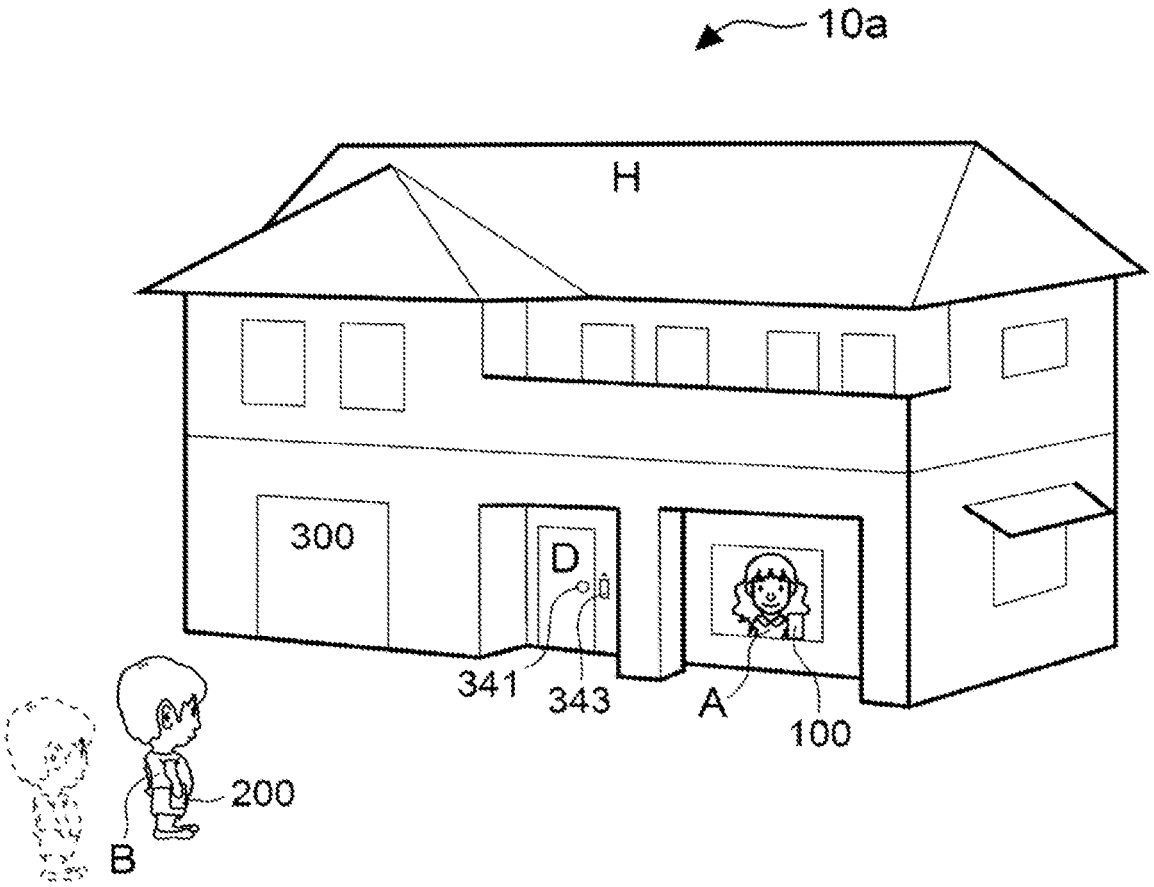
FIG. 1 is a diagram for explaining an outline of a system including a security apparatus according to a first embodiment.

FIG. 1 is a diagram for explaining a security system 10*a* including a security apparatus 300 according to a first embodiment. The security system 10*a* will be described with reference to an example case in which a user carrying a terminal apparatus is located in a house H (area) and another user carrying another terminal apparatus is approaching the house H.

In this description, the terminal apparatus in the house H is called a "first terminal apparatus 100", and the terminal apparatus carried by the user approaching the house H is called a "second terminal apparatus 200", in order to distinguish therebetween. In the same manner, the user carrying the first terminal apparatus 100 is called a "first user A", and the user carrying the second terminal apparatus 200 is called a "second user B". The first user A is a resident of the house H, for example. The first terminal apparatus 100 and the second terminal apparatus 200 are mobile electronic apparatuses, such as a smartphone that can communicate.

The security apparatus 300 determines requirements for unlocking, based on a relationship (e.g., a roommate, a relative or a friend) of the second user B with respect to the first user A. The security apparatus 300 unlocks a lock apparatus 341 on a door D when the requirements for unlocking are satisfied. The lock apparatus 341 is in a locked state, unless otherwise specified. An input device 343 is disposed near the door D. The input device 343 serves as the following: a communicator that communicates to and from the second terminal apparatus 200, a numeric keypad that receives an input operation, an intercom for enabling conversation between a person at an entrance and a person in a living room, a sensor for biometric authentication, such as fingerprint authentication, iris authentication, and/or vein authentication.

In the first embodiment, the requirement for unlocking varies in accordance with the relationship of the second user B with respect to the first user A. For example, when the relationship of the second user B with respect to the first user A is "roommate", the requirement for unlocking is "terminal ID confirmation". When the second user B who is a "roommate" holds the second terminal apparatus 200 to the input device 343, the input device 343 obtains a terminal ID unique to the second terminal apparatus 200 by the function of the communicator. When the terminal ID is valid, the security apparatus 300 unlocks the lock apparatus 341 (for a predetermined period of time). When the relationship of the second user B with respect to the first user A is a "relative", the requirements of unlocking are "terminal ID confirmation" and "password confirmation", for example. The second user B who is a "relative" holds the input device 343 to the second terminal apparatus 200 and inputs a password to the input device 343. When the terminal ID and the password are valid, the security apparatus 300 unlocks the lock apparatus 341. In this manner, according to this embodiment, since the requirements for unlocking vary in accordance with the relationship of the second user B with respect to the first user A, the disadvantage is solved in which when a friend of the father visits, the lock apparatus is unlocked on the bases of the same requirement for unlocking whether the father is in the house H.

When no one is in the house H, a person that is the reference for the relationship is not present. Therefore, the relationship of a visitor may be unknown. Even when someone is in the house H, there may be a case in which the relationship of a visitor may be unknown (in an example case in which the visitor is a home delivery or postal service courier). According to this embodiment, when the relationship is unknown in such a case, the requirement for unlocking for the visitor is that an instruction to unlock is given from a person in the living room by the function of the intercom of the input device 343. Thus, when no one is in the house H, the unlock instruction is not given, and the lock apparatus 341 is therefore not unlocked. Even when someone is in the house H, but when the relationship of a visitor is unknown, the lock apparatus 341 is not unlocked unless the unlock instruction is given from the person in the living room.

Configuration of Components

Figure 2:
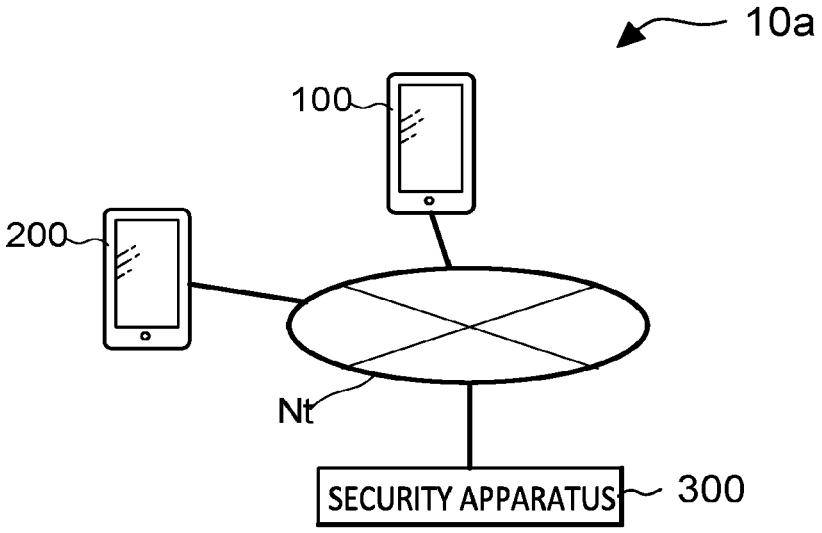
FIG. 2 is a diagram showing a configuration of the system.

FIG. 2 is a diagram showing a configuration of the security system 10*a*. As shown in the figure, the security system 10*a* includes the first terminal apparatus 100, the second terminal apparatus 200 and the security apparatus 300. The first terminal apparatus 100, the second terminal apparatus 200 and the security apparatus 300 communicate with each other over a communication network Nt, such as a mobile communication network or the Internet.

Figure 3:
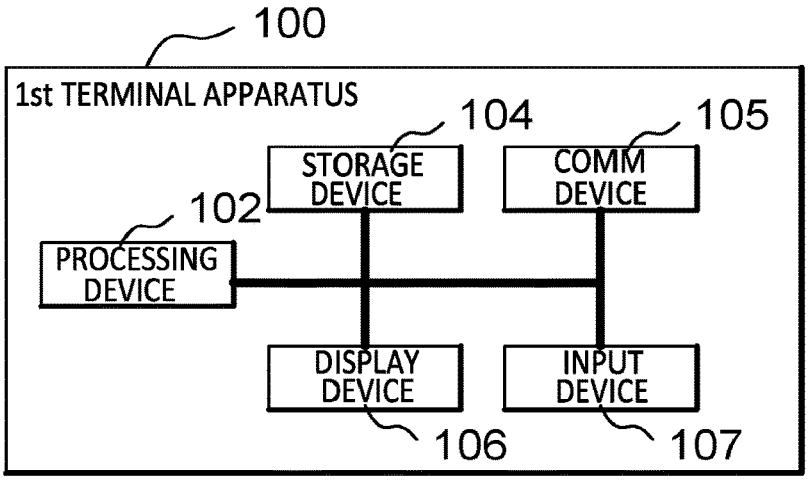
FIG. 3 is a block diagram showing a configuration of a first terminal apparatus.

FIG. 3 is a diagram showing a configuration of hardware in the first terminal apparatus 100. As shown in the figure, the first terminal apparatus 100 is implemented by a computer system including a processing device 102, a storage device 104, a communication device 105, a display device 106, and an input device 107. The components of the first terminal apparatus 100 are connected to each other through one or more buses. The term "apparatus" in this description may be changed to another term, such as a circuit, a device, or a unit. The components of the first terminal apparatus 100 include one or more devices. Some components of the first terminal apparatus 100 may be omitted.

The processing device 102 is a processor that controls the entire first terminal apparatus 100 and includes one or more chips, for example. The processing device 102 includes, for example, a central processing unit (CPU) including an interface to a peripheral device, a computing device and a register, for example. Some or all of the functions of the processing device 102 may be implemented by hardware, such as a digital signal processor (DSP), an application specific integrated circuit (ASIC), a programmable logic device (PLD) and a field programmable gate array (FPGA). The processing device 102 executes processes in parallel or sequentially.

The storage device 104 is a recording medium usable by the processing device 102. The storage device 104 stores programs to be executed by the processing device 102 and data to be used by the processing device 102. The storage device 104 includes one or more kinds of storage circuit, such as a read only memory (ROM), an erasable programmable ROM (EPROM), an electrically erasable programmable ROM (EEPROM) and a random access memory (RAM), for example.

The communication device 105 communicates with another device over the communication network Nt, for example. The communication device 105 is also called a "network device", a "network controller", a network card" or a "communication module". The communication device 105 also performs short-range communication that communicates with another apparatus using infrared, radio waves or the like without passing through the communication network Nt. In addition, the communication device 105 performs position information acquiring that receives a satellite signal in a global positioning system (GPS) and acquires information indicating a current position and a current time of the first terminal apparatus 100.

The display device 106 displays images (including still images and moving images) under control of the processing device 102. For example, various kinds of display panels, such as a liquid crystal display panel or an organic EL display panel, for example, are preferably used as the display device 106. The input device 107 receives an input operation by a user. For example, the input device 107 receives an input operation for inputting a code, such as one of numbers and characters, and an input operation for selecting an icon or a software keyboard displayed by the display device 106. More specifically, a touch panel that detects a contact to a display surface of the display device 106 is used as the input device 107. The input device 107 may include buttons operable by a user. The input device 107 may sense biometric information for biometric authentication.

Figure 4:
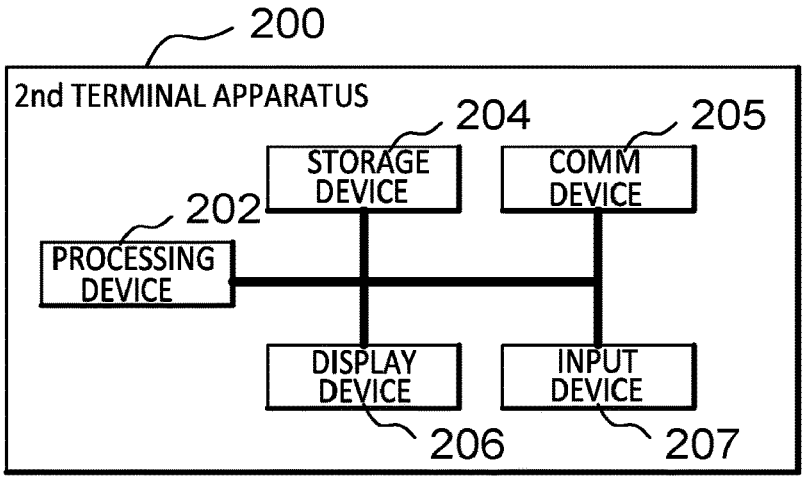
FIG. 4 is a block diagram showing a configuration of a second terminal apparatus.

FIG. 4 is a diagram showing a configuration of hardware in the second terminal apparatus 200. As shown in the figure, the second terminal apparatus 200 is implemented by a computer system including a processing device 202, a storage device 204, a communication device 205, a display device 206, and an input device 207. The configuration of the second terminal apparatus 200 is basically the same as that of the first terminal apparatus 100.

Figure 5:
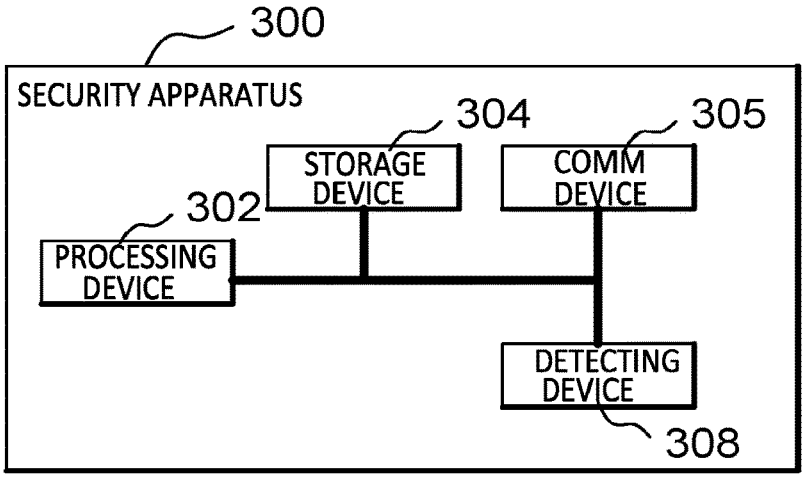
FIG. 5 is a block diagram showing a configuration of the security apparatus.

FIG. 5 is a diagram showing a configuration of hardware in the security apparatus 300. The security apparatus 300 shown in the figure is a mobile or stationary personal computer, for example. The security apparatus 300 is basically implemented by a computer system including a processing device 302, a storage device 304 and a communication device 305, like the first terminal apparatus 100 and the second terminal apparatus 200. The security apparatus 300 includes a detecting device 308. The detecting device 308 detects one or more terminal apparatuses that exist within the house H. As the detecting device 308, a publicly known sensor, such as an active infrared sensor or a passive infrared sensor, may be utilized. Alternatively, a terminal apparatus present in the area of the house H may be detected using a satellite positioning system, such as a global positioning system (GPS).

Function Configuration

FIG. 6 is a block diagram showing examples of functions constructed in the first terminal apparatus 100. As shown in the figure, a controller 150 and a relationship information storage 152 are constructed in the first terminal apparatus 100. The controller 150 is implemented by execution of a program stored in the storage device 104 by the processing device 102. The relationship information storage 152 is implemented by cooperation by the processing device 102 with the storage device 104. The controller 150 controls the components and communicates with the other elements. The relationship information storage 152 stores relationship information as follows.

FIG. 7 is a diagram showing an example of relationship information stored in the relationship information storage 152 in the first terminal apparatus 100. Here, it is assumed that the first terminal apparatus 100 is carried by the first user A. The relationship information on the first user A includes associations among one or more users' names, a terminal ID of a terminal apparatus owned by a user corresponding to the user's name, a relationship to the user. The relationship information is stored in a table form.

According to this embodiment, there are three types of relationship: "roommate", "relative", and "friend". However, there may be two types of relationship, or there may be four or more types of relationship. It is preferable that the first user A update or change the type of relationship of each of the corresponding users as required by selecting the type of relationship from a pulldown menu, for example. In this manner, the relationship for each of the users can be updated or changed by the first user A. This configuration may flexibly address a case in which the relationship is changed with passage of time, or a case in which differences are provided between requirements for unlocking for the users.

FIG. 8 is a block diagram showing a function configuration implemented by execution of a program by the processing device 202 in the second terminal apparatus 200. As shown in the figure, a controller 250 and a preliminary determination inputter 252 are constructed in the second terminal apparatus 200. The controller 250 controls the components and communicates with the other elements. The preliminary determination inputter 252 executes input or detection for biometric authentication for satisfying some requirements for unlocking, as will be described below.

Figures 9, 10:
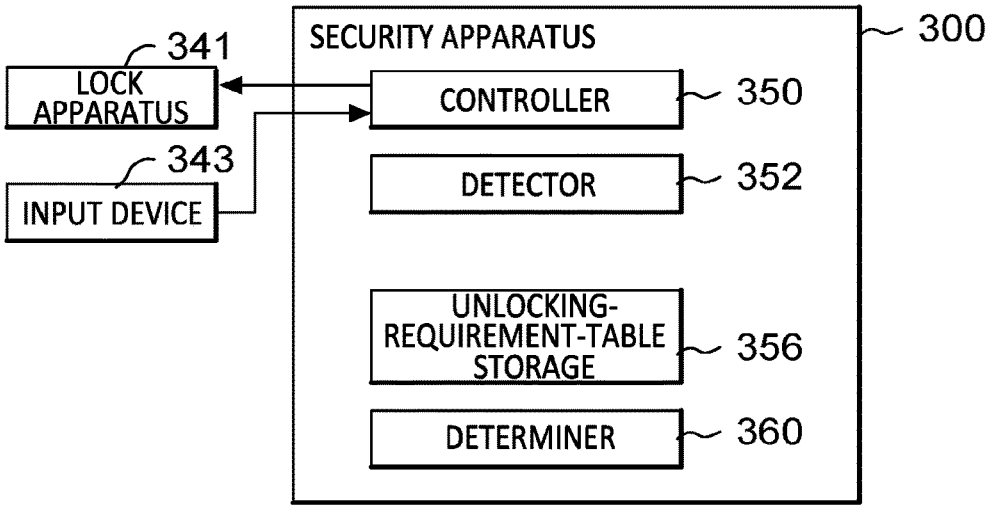
FIG. 9 is a block diagram showing examples of functions constructed in the security apparatus.
FIG. 10 is a diagram showing an example of an unlocking-requirement table.

FIG. 9 is a block diagram showing examples of functions constructed in the security apparatus 300. As shown in the figure, the following are constructed in the security apparatus 300*a*: controller 350, a detector 352, an unlocking-requirement-table storage 356, and a determiner 360. The controller 350 is implemented by execution of a program by the processing device 302. The controller 350 controls the lock apparatus 341 and the input device 343 in addition to the components in the security apparatus 300. The detector 352 detects whether the first terminal apparatus 100 exists in the house H. The detector 352 is implemented by cooperation by the processing device 302 with the detecting device 308. The unlocking-requirement-table storage 356 stores an unlocking-requirement table TBL showing requirements for unlocking for each relationship. The unlocking-requirement-table storage 356 is implemented by cooperation with the processing device 302 with the storage device 304. The determiner 360 determines a requirement for unlocking for the second user B with reference to the unlocking-requirement table TBL, based on information indicating a relationship received from the first terminal apparatus 100, more specifically, information indicating a relationship of the second user B with respect to the first user A.

FIG. 10 is a diagram showing an example of the unlocking-requirement table TBL. As shown in the figure of the unlocking-requirement table TBL, for each relationship, one relationship is associated with at least one requirement for unlocking. More specifically, in the unlocking-requirement table TBL, when the relationship is "roommate", it is associated with one type of "terminal ID confirmation" as a requirement for unlocking. When the relationship is "relative", it is associated with two types of the following: "terminal ID confirmation" (or whether the authentication result based on the terminal ID is valid), and "password confirmation" (or whether the authentication result based on the password is valid), as requirements for unlocking. When the relationship is "friend", it is associated with three types of the following: "terminal ID confirmation", "password confirmation", and "biometric authentication", as requirements of unlocking.

A setting in which preliminary determination is enabled is provided for each of "password confirmation" and "biometric authentication" in the requirements for unlocking. According to this embodiment, when all of the requirements for unlocking are satisfied, the lock apparatus 341 is unlocked. However, the password confirmation and/or detection for the biometric authentication for satisfying the requirements for unlocking may not always require execution of input or detection in the input device 343, but the input and/or detection may be executed in a terminal apparatus of a visitor. The security apparatus 300 can perform preliminary determination for some of the requirements for unlocking on the bases of information input and/or detected in a terminal apparatus of a visitor. When the relationship of a visitor is unknown (when information indicating the relationship is not registered), the requirement for unlocking is an unlock instruction from a person in the living room by the intercom of the input device 343 (confirmation through intercom), as described above.

Operation of Security System

Figure 11:
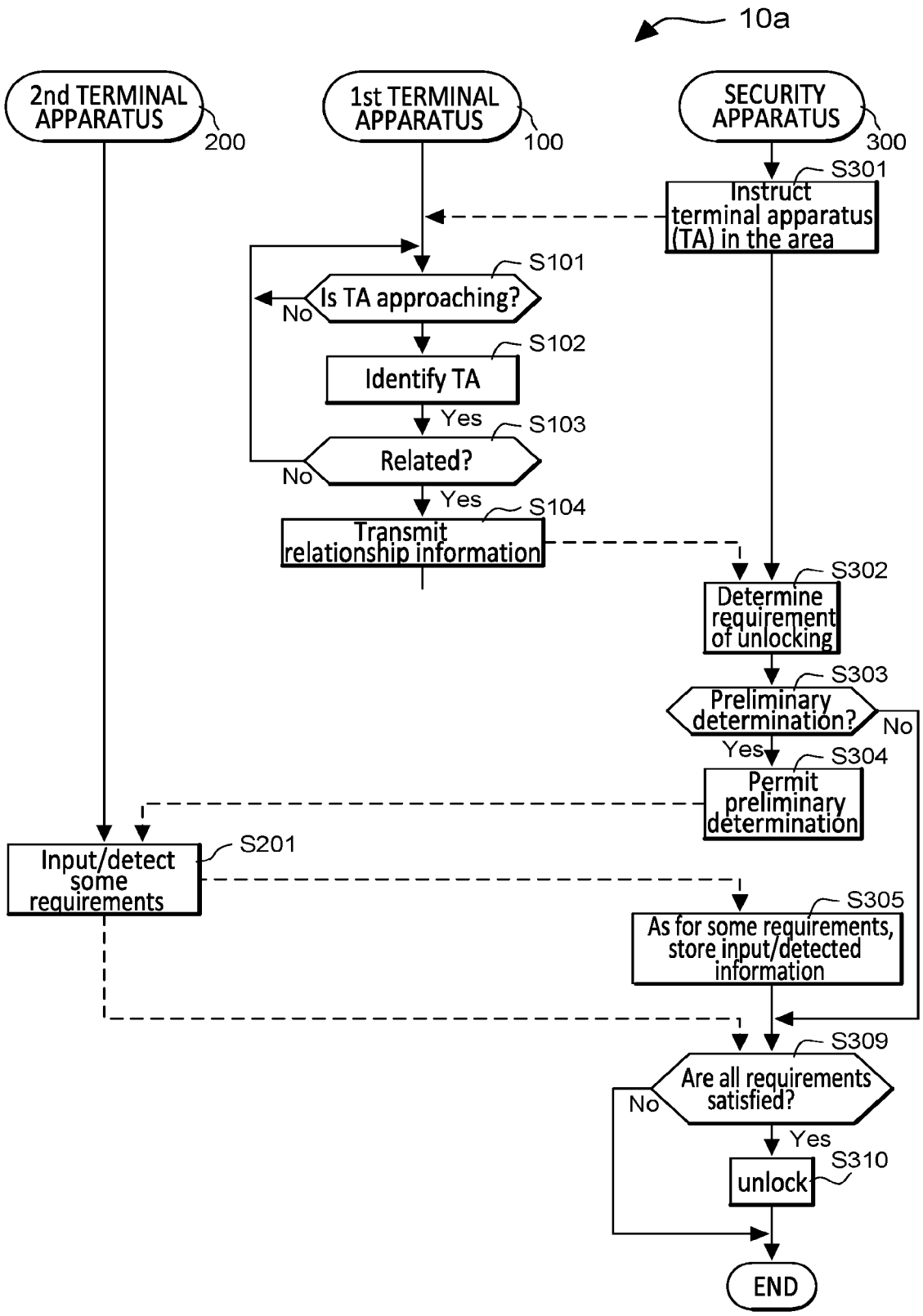
FIG. 11 is a diagram showing an operation of the system.

FIG. 11 is a flowchart showing an operation of the security system 10*a*. As an example, a case will be described according to this embodiment in which the first user A carrying the first terminal apparatus 100 is in the house H and the second user B carrying the second terminal apparatus 200 is approaching the house H. The operation is executed in response to detection of the first terminal apparatus 100 in the house H by the detector 352.

First, the controller 350 in the security apparatus 300 instructs the detected first terminal apparatus 100 over the communication network Nt to detect whether a visitor is approaching the house H (step S301).

The controller 150 in the first terminal apparatus 100 having received the instruction from the controller 350 determines whether a second terminal apparatus 200 approaching the house H is present (step S101). For the detection of the approach, the controller 150 may detect the approach by receiving a beacon issued from the second terminal apparatus 200. Alternatively, the controller 150 may detect the approach by obtaining, from a base station (not shown) of the mobile network Nt, a change in field intensity occurring when the second terminal apparatus 200 is connected to the mobile network Nt, for example.

The controller 150 repeats the determination in step S101 until the approach of the second terminal apparatus 200 is detected. In contrast, when the controller 150 detects the approach of the second terminal apparatus 200 (when the determination result in step S101 is "Yes"), the controller 150 obtains the terminal ID of the second terminal apparatus 200 by, for example, communicating with the second terminal apparatus 200 (step S102).

Next, the controller 150 accesses the relationship information storage 152 and determines whether the terminal ID of the second terminal apparatus 200 is included in the relationship information (step S103). When the terminal ID of the second terminal apparatus 200 is included in the relationship information (when the determination result in step S103 is "Yes"), the controller 150 transmits the terminal ID and information indicating a relationship associated with the terminal ID to the security apparatus 300 (step S104). In contrast, when the terminal ID of the second terminal apparatus 200 is not included in the relationship information (when the determination result in step S103 is "No"), the controller 150 returns the procedure of the processing to step S101. Thus, when the terminal ID of the second terminal apparatus 200 is not included in the relationship information even when the approach of the second terminal apparatus 200 is detected, the controller 150 does not transmit any information to the security apparatus 300.

Since this embodiment assumes that the second user B carries the second terminal apparatus 200, the controller 150 obtains "XXXX-01" (see FIG. 7) that is the terminal ID of the second terminal apparatus 200. Thus, the following two users are specified: the first user A carrying the first terminal apparatus 100 in the house H, and the second user B carrying the second terminal apparatus 200 approaching the house H. The controller 150 transmits "XXXX-01" that is the terminal ID of the second terminal apparatus 200 and information indicating a relationship (or "friend") associated with the terminal ID to the security apparatus 300.

In the security apparatus 300, when the controller 350 receives the terminal ID of the second terminal apparatus 200 approaching the house H and the information indicating the relationship associated with the terminal ID, the determiner 360 determines the requirement for unlocking associated with the relationship indicated by the information as a requirement for unlocking for the user associated with the terminal ID with reference to the unlocking-requirement table TBL (step S302). In this embodiment, since the relationship associated with the terminal TD "XXXX-01" is "friend", the three types of "terminal ID confirmation", "password confirmation" and "biometric authentication" are determined to be requirements for unlocking.

Next, the controller 350 determines whether the determined requirements for unlocking include a type that enables preliminary determination (step S303). When the requirements do not include it (when the determination result in step S303 is "No"), the controller 350 skips the procedure of the processing to step S309. In contrast, when the requirements include it (when the determination result in step S303 is "Yes"), the controller 350 notifies the second terminal apparatus 200 with the terminal ID received in step S302 of that input to satisfy the requirement for unlocking that enables preliminary determination or detection for biometric authentication is permitted (step S304). Here, when the requirements for unlocking are determined to be "terminal ID confirmation", "password confirmation" and "biometric authentication", the controller 350 notifies the second terminal apparatus 200 of that execution, in the second terminal apparatus 200, of input or detection for satisfying the requirements of unlocking "password confirmation" and "biometric authentication" among them is permitted.

In contrast, in the second terminal apparatus 200 having received the notification of the permission of input or detection for satisfying the requirements of unlocking, a password is confirmed or a fingerprint, iris or vein pattern for biometric authentication is detected by the preliminary determination inputter 252. The controller 250 transmits the input or detected information to the security apparatus 300 over the communication network Nt (step S201). In some cases, some second terminal apparatuses 200 do not have a sensor for biometric authentication. Thus, all of information satisfying the requirements of unlocking that enables preliminary determination may not be input to the preliminary determination inputter 252, or may not be detected by the preliminary determination inputter 252.

When receiving the information that is input or detected for satisfying the requirements for unlocking that enables preliminary determination, the controller 350 temporarily stores therein the information (step S305). When the second user B arrives at the house H and holds the second terminal apparatus 200 to the input device 343, the controller 350 determines whether all of the requirements for unlocking determined for the second user are satisfied (step S309). When not all of the requirements for unlocking are satisfied (when the determination result in step S309 is "No"), the controller 350 causes the operation to end. Thus, the lock apparatus 341 is maintained to be in a locked state. The controller 350 may notify the fact to the visitor by using an audio output device or a display, without immediately ending the operation.

In contrast, when all of the requirements of unlocking are satisfied (when the determination result in step S309 is "Yes"), the controller 350 instructs the lock apparatus 341 to unlock (step S310). Thus, the lock apparatus 341 is unlocked, and the visitor (second user B) is enabled to enter the house H. The case in which all of the requirements of unlocking are satisfied includes both of the following cases (i) and (ii): (i) a case in which all of the information for satisfying the requirements for unlocking are input or detected through the input device 343, and (ii) a case in which some of the information for satisfying the requirements of unlocking is input or detected by the preliminary determination inputter 252 and the remaining part of the information for satisfying the requirements for unlocking is input or detected through the input device 343.

With the security apparatus 300 according to the first embodiment, requirements for unlocking are determined in accordance with the relationship of the second user B with respect to the first user A, the first user A being in the house H to which entry is limited by the lock apparatus 341. When the requirements of unlocking are satisfied, the lock apparatus 341 is unlocked. Therefore, the disadvantage can be solved, in which when a friend of the farther visits, the unlocking is executed under the same requirements for unlocking whether the father is in the area. The information for satisfying a requirement for unlocking that enables preliminary determination may be input by the second user B to or detected by the second terminal apparatus 200 before the second user B reaches the input device 343. Thus, the time and trouble of the second user B for satisfying all requirements for unlocking may be distributed.

According to the first embodiment, the determiner 360 may change requirements for unlocking for the second user B in accordance with the history, more specifically, the number of times or frequency of the unlocking of the lock apparatus 341 on the bases of the satisfaction of the requirements for unlocking for the second user B. More specifically, as the number of times or frequency of actual unlocking of the lock apparatus 341 on the bases of the satisfaction of the requirements for unlocking for the second user B increases, the determiner 360 may ease the requirements of unlocking for the second user B (or reduce the number of types of requirements for unlocking).

According to the first embodiment, the second terminal apparatus 200 executes input or detection of information for satisfying requirements for unlocking. Without limiting thereto, the preliminary determination inputter 252 in the second terminal apparatus 200 may execute determination on whether the input or detected information is valid and transmit the determination result to the security apparatus 300.

Second Embodiment

Figure 12:
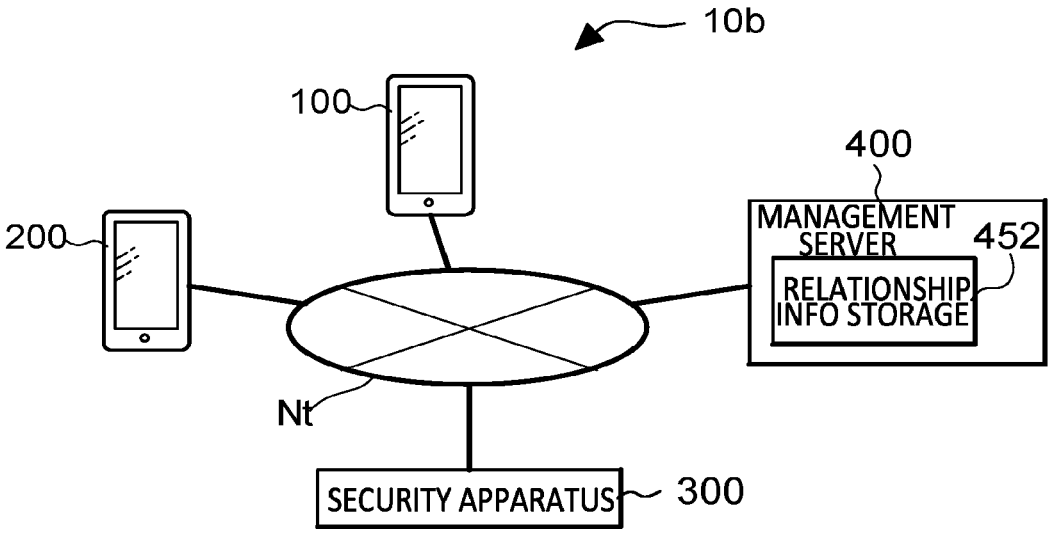
FIG. 12 is a diagram showing a configuration of a system including a security apparatus according to a second embodiment.

FIG. 12 is a diagram showing a configuration of a security system 10*b* including a security apparatus 300 according to a second embodiment. The security system 10*b* shown in the figure is different from the security system 10*a* shown in FIG. 2 in that a management server 400 is connected to the communication network Nt, and the management server 400 has a relationship information storage 452 and manages relationship information. Therefore, the first terminal apparatus 100 does not have to store relationship information.

An operation of the security system 10*b* will be described below. More specifically, when the detector 352 in the security apparatus 300 detects the first terminal apparatus 100 in the house H, the controller 350 transmits the terminal ID of the first terminal apparatus 100 to the management server 400. When the first terminal apparatus 100 obtains the terminal ID of the approaching second terminal apparatus 200, the controller 150 transmits the terminal ID of the second terminal apparatus 200 to the management server 400. Thus, the management server 400 identifies the first user A associated with the terminal ID of the first terminal apparatus 100 and the second user B associated with the terminal ID of the second terminal apparatus 200. Therefore, the relationship of the second user B with respect to the first user A can be obtained with reference to the relationship information storage 452. When the management server 400 transmits the information indicating the obtained relationship to the security apparatus 300, the determiner 360 in the security apparatus 300 can determine requirements for unlocking for the second user B based on the relationship indicated by the information.

When the management server 400 manages relationship information of the first user A carrying the first terminal apparatus 100, the following advantages are provided. The management server 400 analyzes the contacts through social networking services (SNS), and transferring of e-mails so that the relationship with other users with reference to the first user A may be automatically set and updated, for example. Thus, the first user A is not required to perform operations for setting relationships with other users. In the second embodiment, the first user may update or change the relationship of each user as required. For example, in accordance with a change in relationship between the first user and another user, the first user may change the relationship setting.

Third Embodiment

Next, a security apparatus 300 according to third embodiment will be described. The configuration of a security system 10*c* including the security apparatus 300 according to the third embodiment is the same as that of the security system 10*a* (see FIG. 2) but an operation thereof is different. The third embodiment will be described focusing on the operation.

Figure 13:
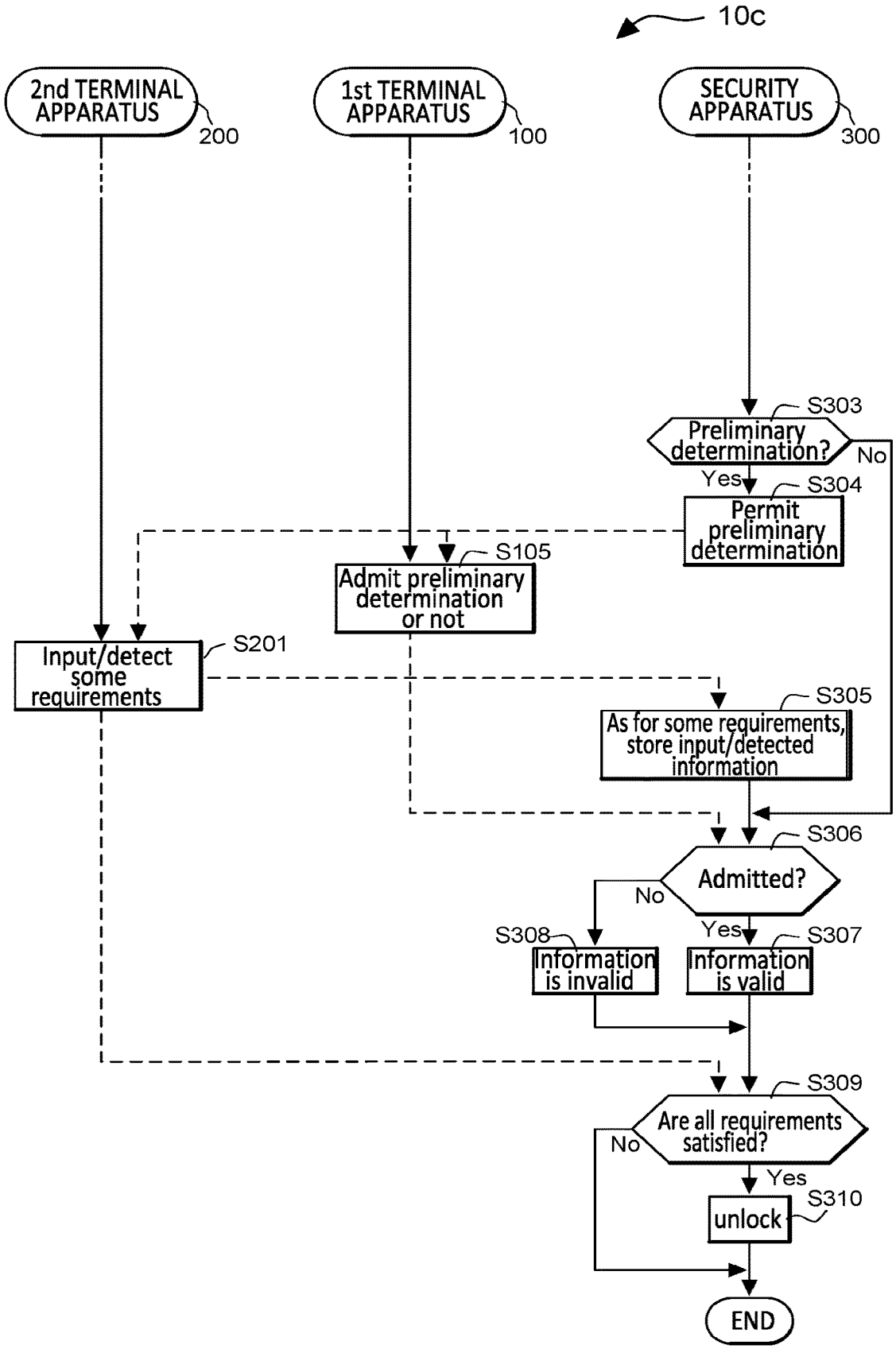
FIG. 13 is a diagram showing an operation of a system including a security apparatus according to a third embodiment.

FIG. 13 is a flowchart showing the operation of the security system 10*c* including the security apparatus 300 according to the third embodiment. The flowchart shown in FIG. 13 is different from the flowchart shown in FIG. 11 in that steps S105, S306, S307 and S308 are added. In FIG. 13, the steps before step S105 are omitted in the procedure by the first terminal apparatus 100, and the steps before step S303 are omitted in the procedure by the security apparatus 300.

When the determined requirements of unlocking include one that enables preliminary determination (when the determination result in step S303 is "Yes"), the controller 350 performs the processing in step S304. More specifically, the controller 350 notifies the second terminal apparatus 200 of permission of input for satisfying the requirement for unlocking that enables preliminary determination or detection for biometric authentication. The controller 350 instructs the first terminal apparatus 100 to ask whether the input to the second terminal apparatus 200 or detection by the second terminal apparatus 200 is admitted. When receiving the instruction, the controller 150 in the first terminal apparatus 100 causes the display device 106 to display a message asking whether the input or detection is admitted. The first user A performs an operation according to a case in which the input or detection is admitted or a case in which the input or detection is not admitted (step S105). The controller 150 transmits the operation result to the security apparatus 300.

In contrast, after receiving information input or detected for satisfying the requirement for unlocking that enables preliminary determination and temporarily storing the information (after step S305), the controller 350 determines whether an answer that admits the input or detection has been given from the first terminal apparatus 100 within a predetermined period of time (e.g., within one minute) (step S306). The starting point of reckoning of the predetermined time refers to a time when the instruction in step S304 is given.

When an answer that admits the input or detection is given (when the determination result in step S306 is "Yes"), the controller 350 determines that the temporarily stored information, that is, the information input or detected for satisfying the requirement for unlocking that enables preliminary determination is valid (step S307). Thus, in step S309, determination using the information input or detected for satisfying the requirement for unlocking that enables preliminary determination is executed.

In contrast, when an answer that does not admit the input or detection is given or when no answer is given within the predetermined period of time (when the determination result in step S306 is "No"), the controller 350 determines that the information input or detected for satisfying the requirement for unlocking that enables preliminary determination is invalid (step S308). Thus, in step S309, the determination is executed without using the information input to the second terminal apparatus 200 or detected by the second terminal apparatus 200 for satisfying the requirement for unlocking that enables preliminary determination.

According to the third embodiment as described above, the security characteristic is improved, since the first user A may individually determine whether the information is input to the second terminal apparatus 200 or the information is detected by it for satisfying a requirement for unlocking that enables preliminary determination is to be admitted.

Fourth Embodiment

Next, a security apparatus 300 according to a fourth embodiment will be described. The configuration of a security system 10*d* including the security apparatus 300 according to the fourth embodiment is the same as that of the security system 10*a* (see FIG. 2) but operation thereof is different. The fourth embodiment will be described also with focus on the operation.

Figure 14:
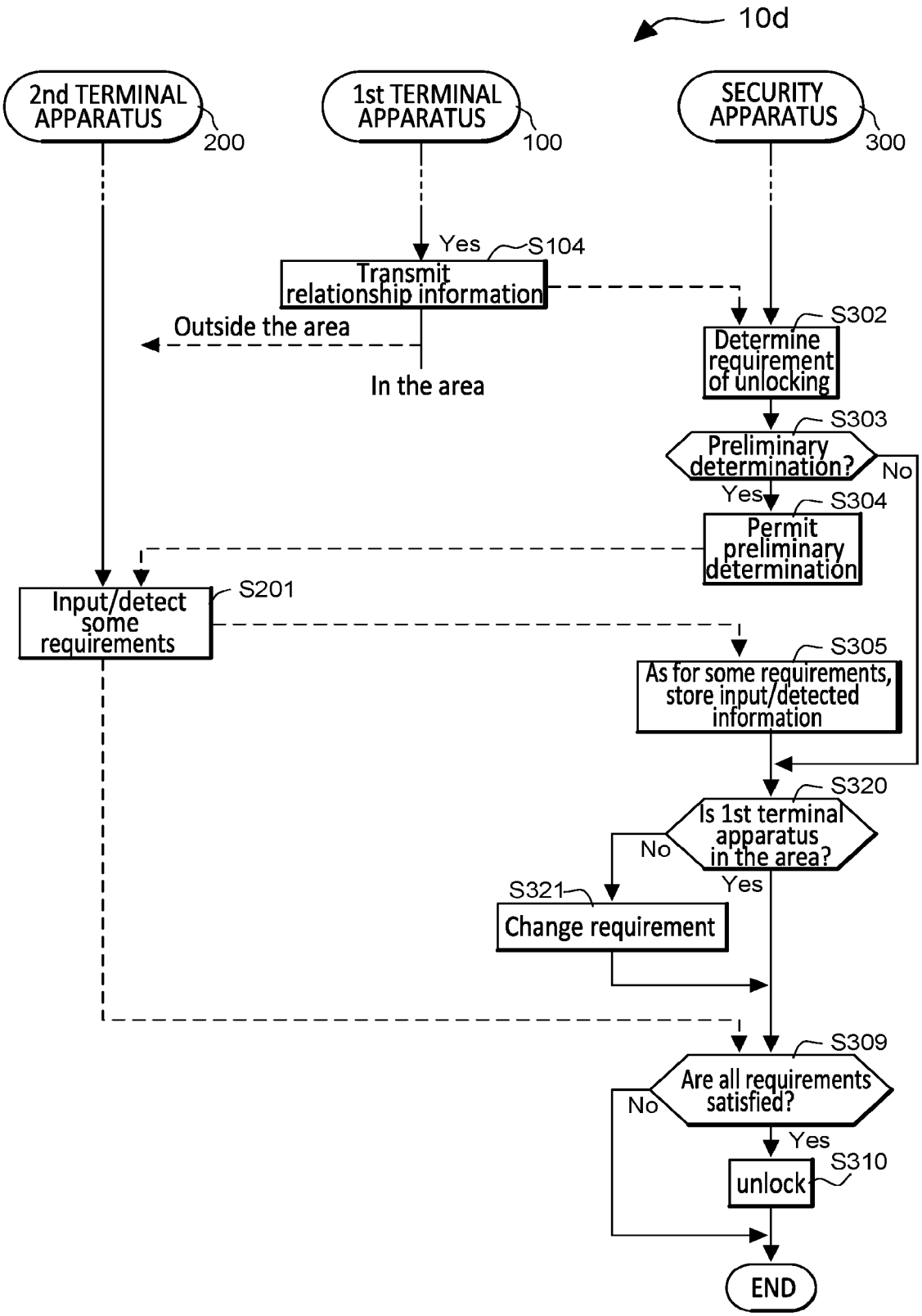
FIG. 14 is a diagram showing an operation of a system including a security apparatus according to a fourth embodiment.

FIG. 14 is a flowchart showing the operation of the security system 10*d* including the security apparatus 300 according to the fourth embodiment. The flowchart shown in FIG. 14 is different from the flowchart shown in FIG. 11 in that movement of the first terminal apparatus 100 after step S104 is considered and that steps S320 and S321 are added. In FIG. 14, the steps before step S104 are omitted in the procedure by the first terminal apparatus 100, and the steps before step S302 are omitted in the procedure by the security apparatus 300.

In the fourth embodiment, it is assumed that the first user A carrying the first terminal apparatus 100 exits the house H for some reason after the controller 150 transmits the terminal ID of the second terminal apparatus 200 and information indicating a relationship associated with the terminal ID to the security apparatus 300.

After receiving information input or detected in the second terminal apparatus 200 for satisfying a requirement for unlocking that enables preliminary determination and temporarily storing the information (after step S305), the controller 350 causes the detector 352 to detect whether the first terminal apparatus 100 is present in the house H (step S320).

When the detector 352 detects that the first terminal apparatus 100 is present in the house H (when the determination result in step S320 is "Yes"), the controller 350 determines whether all of requirements of unlocking determined for the second user are satisfied (step S309), like the first embodiment. In contrast, when the detector 352 detects that the first terminal apparatus 100 is not present in the house H (when the determination result in step S320 is "No"), the controller 350 changes the requirements for unlocking for the second user B to "confirmation through the intercom" under "not registered" (step S321). Thus, even if the requirements for unlocking before the change are satisfied when the second user B arrives at the house H, the lock apparatus 341 is not unlocked unless an unlock instruction is given from a person in the living room through the intercom function in the input device 343.

According to the fourth embodiment as described above, because the requirements for unlocking are changed when the first user A who is a basis of the relationship exits the house H, the security characteristic may be improved. According to the fourth embodiment, when the determination result in step S320 is "No", the controller 350 may determine that the information input or detected in the second terminal apparatus 200 for satisfying a requirement for unlocking that enables preliminary determination is invalid.

Fifth Embodiment

Next, a fifth embodiment will be described. The fifth embodiment has a configuration in which the first terminal apparatus 100 includes the functions of the security apparatus 300 according to the first embodiment, for example. In other words, according to the fifth embodiment, the first terminal apparatus 100 serves as the security apparatus 300 in the first embodiment. According to the fifth embodiment, the first terminal apparatus 100 communicates with the lock apparatus 341 and the input device 343 over a network in the house H, or directly communicates with them.

Figure 15:
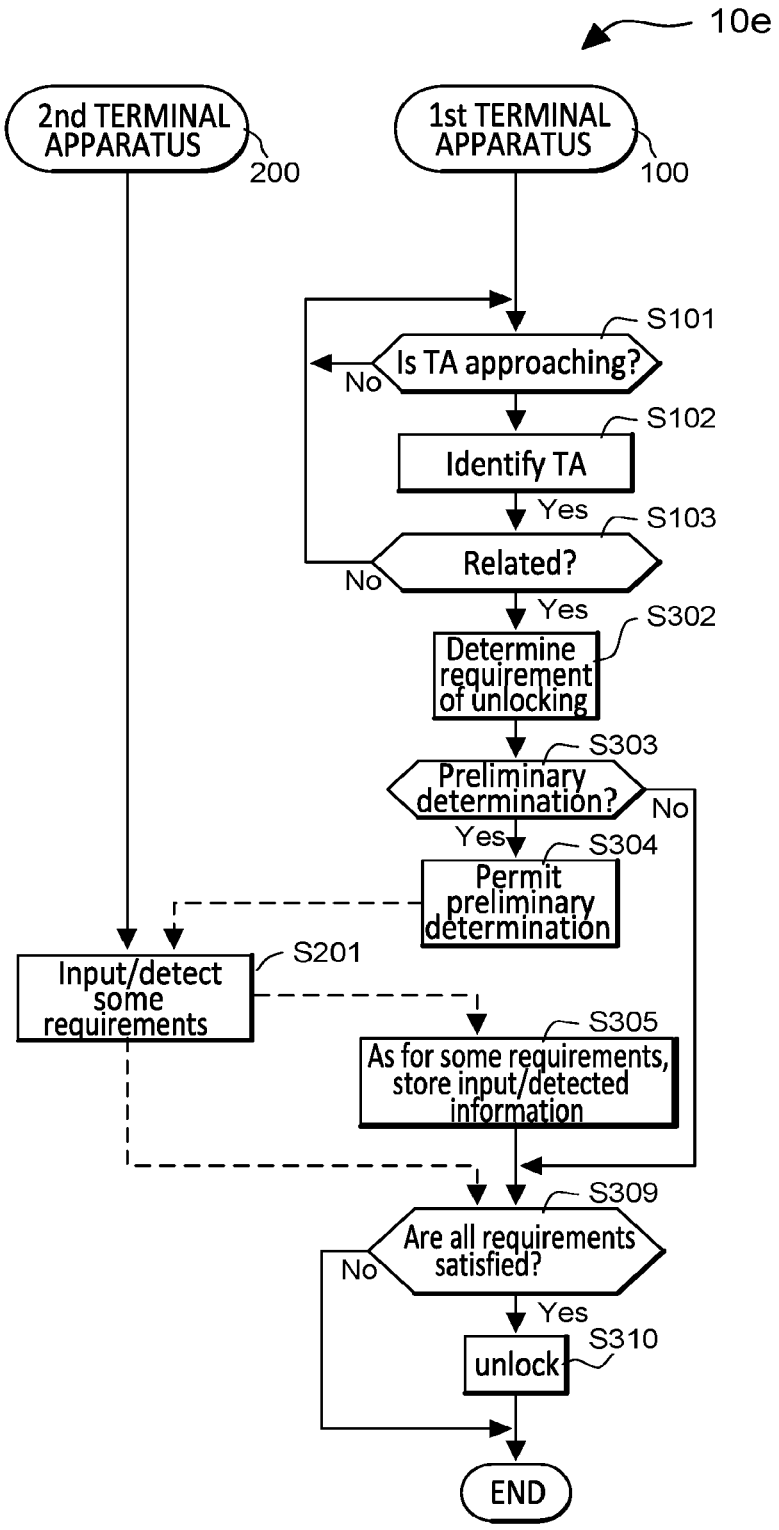
FIG. 15 is a diagram showing an operation of a system including a security apparatus according to a fifth embodiment.

FIG. 15 is a flowchart showing an operation of the security system 10*e* including the first terminal apparatus 100 and the second terminal apparatus 200 in the fifth embodiment. The flowchart shown in FIG. 15 is different from the flowchart shown in FIG. 11 in that the first terminal apparatus 100 executes processing, in and subsequent to, step S302. This is implemented by execution by the first terminal apparatus 100 of the program executed by the security apparatus 300 according to the first embodiment, for example.

In brief, regarding the fifth embodiment, the first terminal apparatus 100 is carried by the first user A who is in the house H, and executes the following (i) to (iv): (i) the determination of requirements for unlocking, (ii) the enabling of preliminary determination, (iii) the determination of satisfaction of the requirements for unlocking, and (iv) the unlock instruction given to the lock apparatus 341 when the requirements for unlocking are satisfied. Detailed description of steps S302-S305, S309, and S310 in FIG. 15 will be omitted, since the subject of the operation in FIG. 11 is merely changed from the security apparatus 300 to the first terminal apparatus 100.

According to the fifth embodiment, when the terminal ID of the second terminal apparatus 200 is included in the relationship information in step S103, the first terminal apparatus 100 decides a requirement for unlocking by itself (step S302). Therefore, the procedure corresponding to step S104 in FIG. 11 does not exist in FIG. 15. In step S201, when a password is confirmed or a fingerprint, iris or vein pattern for biometric authentication is detected by the preliminary determination inputter 252 in the second terminal apparatus 200, the controller 250 transmits the input or detected information to the first terminal apparatus 100.

According to the fifth embodiment as described above, since it is no longer required to provide the first terminal apparatus 100 separately from the security apparatus 300 as in the first embodiment, the configuration is simplified. In the fifth embodiment, the first terminal apparatus 100 includes the functions of the security apparatus 300 according to the first embodiment. However, the first terminal apparatus 100 may include the functions of the security apparatus 300 according to the third embodiment or the fourth embodiment. The relationship information storage, which is provided in the first terminal apparatus 100 including the functions of the security apparatus 300, may be provided in the management server 400 as in the second embodiment.

In the first to fifth embodiments, the area to which entry is limited by the lock apparatus 341 is described as the house H. However, the area may be a room requiring confidentiality, such as a conference room and a store other than the house H. In the first to fifth embodiments, the first terminal apparatus 100 detects the second terminal apparatus 200 approaching the area to which entry is limited by the lock apparatus 341. However, this detection may be performed by the security apparatus 300 or may be performed by another server apparatus.

Other Matters

In the exemplarily flowcharts shown, the order of the steps may be changed. In other words, the order of the processes in the preferred aspects of the present invention is not limited to the specific order.

The functions exemplarily shown in FIGS. 3 to 5 are implemented by a freely chosen combination of hardware and software. The functions may be implemented by a single device or may be implemented by two or more devices that are configured as separate devices from each other.

The program should be broadly interpreted so as to refer to an instruction, an instruction set, code, a code segment, program code, a sub program, a software module, an application, a software application, a software package, a routine, a subroutine, an object, an executable file, an execution thread, a procedure, a function or the like, whether the program is called software, firmware, middleware, microcode or a hardware description language, or is called something else.

The software, the instructions and the like may be transmitted and received through a transmission medium. For example, when the software is transmitted from a website, a server or another remote source using a wired technology such as a coaxial cable, an optical fiber cable, a twisted pair and a digital subscriber line (DSL) and/or a wireless technology such as an infrared, radio waves, and microwaves, these wired technologies and/or the wireless technologies are included within the definition of the transmission medium.

The aspects/embodiments described herein are applicable to systems utilizing long term evolution (LTE), LTE-advanced (LTE-A), SUPER 3G, IMT-Advanced, 4G, 5G, future radio access (FRA), W-CDMA (registered trademark), GSM (registered trademark), CDMA2000, ultra mobile broadband (UMB), IEEE 802.11 (Wi-Fi), IEEE 802.16 (WiMax), IEEE 802.20, Ultra-WideBand (UWB), Bluetooth (registered trademark) and other proper systems and/or next generation systems extended based on thereon.

The information or the like that has been input or output may be saved in a specific location (such as a memory) or may be managed in a management table. The information or the like that is input or output may be overwritten, updated, or additionally written. The information or the like that has been output may be deleted. The information or the like that has been input may be transmitted to another device.

The determination may be performed in accordance with a value (0 or 1) indicated by 1 bit, may be performed in accordance with a truth value (Boolean: true or false), or may be performed by a comparison of numerical values (e.g., a comparison with a predetermined value).

Each of the aspects and embodiments described herein may be used alone, may be used in combination or may be switched in association with execution.

The information, signals and the like described herein may be indicated by using any one of a variety of different technologies. For example, data, instructions, commands, information, signals, bits, symbols, chips and the like which may be mentioned throughout the entire description above may be indicated by voltages, currents, electromagnetic waves, magnetic fields or magnetic particles, optical fields or photons, or a freely selected combination thereof.

The terms "system" and "network" used herein are interchangeably used.

The information and the like described herein may be indicated by absolute values, may be indicated by relative values with respect to predetermined values, or may be indicated by corresponding other types of information. For example, radio resources may be instructed with an index.

Mobile stations are preferable as the first terminal apparatus 100 and the second terminal apparatus 200 described above. Those skilled in the art may call each mobile station as a subscriber station, a mobile unit, a subscriber unit, a wireless unit, a remote unit, a mobile device, a wireless device, a wireless communication device, a remote device, a mobile subscriber station, an access terminal, a mobile terminal, a wireless terminal, a remote terminal, a handset, a user agent, a mobile client, a client, or other proper terms.

The term "connected" or any variation thereof refers to any direct or indirect connection or coupling between two or more elements and may include the presence of one or more intermediate elements between two elements that are "connected" to each other. The coupling or connection between elements may be physical, logical or a combination thereof. When the term is used herein, two elements may be considered to be "connected" to each other by using one or more electric wires, cables and/or a printed electrical connection and by using electromagnetic energy such as electromagnetic energy having a wavelength in a radio frequency domain, a microwave region, and a light (both visible and invisible) region as some non-limiting and non-exhaustive examples.

Although the storage devices 104, 204 and 304 refer to a recording circuit, such as a ROM and a RAM in the embodiments, they may be a flexible disk, a magneto-optical disk (e.g., as a compact disk, a digital versatile disk, or a Blu-ray (registered trademark) disk), a smart card, a flash memory device (e.g., a card, a stick, or a key drive), a compact dis-ROM (CD-ROM), a register, a removable disk, a hard disk, a floppy (registered trademark) disk, a magnetic strip, a database, a server or other proper storage media. The program may be transmitted through a telecommunication circuit.

In this description, when articles such as "a", "an" and "the" in English are added by translation, these articles includes a plurality thereof, unless clearly indicated that this is not so from context.

It is apparent to those skilled in the art that the present invention is not limited to the embodiments described herein. The present invention may be implemented as a modified or changed aspect without departing from the spirit and scope of the present invention provided based on the recitation in the claims. Therefore, the description herein is given for the purpose of exemplary explanation and does not have any limiting meaning for the present invention. Aspects selected from the aspects exemplarity described herein may be combined.

DESCRIPTION OF REFERENCE SIGNS

10*a*, 10*b*, 10*c*, 10*d*, 10*e*: security system, 100: first terminal apparatus, 152: relationship information storage, 200: second terminal apparatus, 300: security apparatus, 341: lock apparatus, 352: detector, 356: unlocking-requirement table storage, 360: determiner

The invention claimed is:

1. A security apparatus comprising:

a processor configured to:

when (i) a first user associated with a first terminal apparatus within an area to which entry is limited by a lock apparatus and (ii) a second user associated with a second terminal apparatus approaching the area are identified, determine a requirement for unlocking in which the lock apparatus is unlocked by the second user in accordance with a relationship of the second user with respect to the first user including a level of familiarly between the first and second users;

determine whether the requirement for unlocking is satisfied;

when the requirement for unlocking is satisfied, control unlocking of the lock apparatus;

when information indicative of the relationship of the second user with respect to the first user is included in stored relationship information indicative of a relationship of at least one user different from the first user with respect to the first user, determine the requirement for unlocking based on the information indicative of the relationship of the second user with respect to the first user; and when the information indicative of the relationship of the second user with respect to the first user is not included in the stored relationship information, determine a predetermined requirement different from the requirement for unlocking determined based on the information indicative of the relationship of the second user with respect to the first user to be the requirement for unlocking.

2. The security apparatus according to claim 1, wherein:

the stored relationship information is managed in a server that is connected to the security apparatus over a network, and the processor is configured to determine the requirement for unlocking based on the stored relationship information obtained from the server over the network.

3. The security apparatus according to claim 1, wherein:

the processor is configured to change the requirement for unlocking for the second user to a different requirement for unlocking in accordance with a number of times or frequency of unlocking of the lock apparatus based on satisfaction of the requirement for unlocking for the second user.

4. The security apparatus according to claim 1, wherein:

the requirement for unlocking includes a plurality of respective requirements for unlocking, and when the processor receives, from the second terminal apparatus, one or more respective pieces of information for satisfying one or more of the plurality of respective requirements for unlocking for the second user, the processor is configured to determine whether the one or more of the plurality of respective requirements for unlocking are satisfied by using the one or more respective pieces of information.

5. The security apparatus according to claim 1, wherein:

the requirement for unlocking includes a plurality of respective requirements of unlocking, and when the processor receives, from the first terminal apparatus, an answer that is received from the second terminal apparatus, the answer being an answer that does not admit use of information either input to the second terminal apparatus or detected by the second terminal apparatus for satisfying one or more of the plurality of respective requirements of unlocking, or when the processor does not receive, from the first terminal apparatus within a predetermined period of time, an answer that admits the use of the information either input to the second terminal apparatus or detected by the second terminal apparatus for satisfying the one or more of the plurality of respective requirements of unlocking:

the processor is configured to invalidate the information received from the second terminal apparatus, the information being the information either input the second terminal apparatus or detected by the second terminal apparatus for satisfying the one or more of the plurality of respective requirements of unlocking.

6. The security apparatus according to claim 1, wherein:

when the processor determines the requirement for unlocking based on information indicative of the relationship of the second user with respect to the first user, and then the first terminal apparatus goes out of the area before the processor determines whether the requirement for unlocking is satisfied:

the processor is configured to change the requirement for unlocking to a predetermined requirement that is different from the requirement for unlocking based on the information indicative of the relationship of the second user with respect to the first user.

7. A method for controlling a security apparatus, the method being executed by a computer, the method comprising:

identifying (i) a first user associated with a first terminal apparatus within an area to which entry is limited by a lock apparatus and (ii) a second user associated with a second terminal apparatus approaching the area;

determining a requirement for unlocking of the lock apparatus for the second user in accordance with a relationship of the second user with respect to the first user including a level of familiarity between the first and second users;

determining whether the requirement for unlocking is satisfied;

controlling, when the requirement for unlocking is satisfied by the determining, unlocking for the lock apparatus;

determining, when information indicative of the relationship of the second user with respect to the first user is included in stored relationship information indicative of a relationship of at least one user different from the first user with respect to the first user, the requirement for unlocking based on the information indicative of the relationship of the second user with respect to the first user; and determining, when the information indicative of the relationship of the second user with respect to the first user is not included in the stored relationship information, a predetermined requirement different from the requirement for unlocking determined based on the information indicative of the relationship of the second user with respect to the first user to be the requirement for unlocking.

* * * * *